US005111754A

United States Patent [19]

Adams, Jr.

[11] Patent Number: 5,111,754

[45] Date of Patent: May 12, 1992

[54] PORTABLE SHIPPING PLATFORM FOR USE WITH SLIPSHEET HANDLING EQUIPMENT AND FORK LIFTS

[76] Inventor: Stephen C. Adams, Jr., 14605 SE. 45th St., Bellevue, Wash. 98006

[21] Appl. No.: 541,955

[22] Filed: Jun. 22, 1990

[51] Int. Cl.[5] ..... B65D 19/00

[52] U.S. Cl. ..... 108/51.3; 108/51.1

[58] Field of Search ..... 108/51.1, 51.3

[56] References Cited

U.S. PATENT DOCUMENTS

| | | | |
|---|---|---|---|
| 2,611,569 | 9/1952 | Coleman et al. | 108/51.3 |
| 3,079,876 | 3/1963 | Doane | 108/51.3 |
| 3,275,131 | 9/1966 | Erickson | 108/51.1 X |
| 3,552,328 | 1/1971 | Sullivan | 108/51.3 |
| 4,085,847 | 4/1978 | Jacalone | 108/51.3 X |
| 4,735,153 | 4/1988 | Wong | 108/51.1 |

*Primary Examiner*—Kenneth J. Dorner
*Assistant Examiner*—Milton Nelson, Jr.
*Attorney, Agent, or Firm*—Wegner, Cantor, Mueller & Player

[57] ABSTRACT

A portable shipping platform is provided which is particularly adapted for handling by both fork lift and slipsheet types of devices. The portion by which the platform is grippable in slipsheet fashion also provides a protector for subjacent surfaces from tips of the blades of a fork lift as well as a guide for vertical alignment of the blades with the platform. Tabs also may be situated above the entry ways of channels for receiving the fork lift blades, with these tabs serving to guide the spaced blades, as well as to prevent closing of the entryways by sagging loads, and to protect the loads from the blade tips during entry into and exit from the channels.

16 Claims, 2 Drawing Sheets

PORTABLE SHIPPING PLATFORM FOR USE WITH SLIPSHEET HANDLING EQUIPMENT AND FORK LIFTS

BACKGROUND OF THE INVENTION

The invention relates to portable shipping platforms or pallets which are particularly adapted for handling, interchangeably, by slipsheet and fork lift devices.

Since its inception around the turn of the century, the wooden shipping pallet has been the cornerstone of "materials handling" as we know it today. For the most part, it has been the platform on which most of the world's goods have been stored, warehoused, transported, and distributed.

As time has passed however, and business and industry has become more cost-conscious and efficient, numerous problems associated with this device have become evident, to wit:

Logistical

Since the pallet was constructed to allow ample clearances (usually 3–4") for entry of handling devices such as pallet jacks and lift trucks, and was constructed of dimensional lumber of sufficient thickness for the strength required, the resulting height (5–6") and overall size of each pallet limited the cost effective shipping of them from supply source to user. Even today, no more than 300 to 400 pallets can be shipped on a standard 40 ft. trailer, which precludes a cost-effective supply pipeline of any more than nominal distances (300–400 miles). This geographical limitation extends on down through the distribution channel, precluding the efficient return of pallets, from the receiver of goods to the shipper of goods, for reuse.

Storage

Due to the configurations outlined above, a sufficient supply occupies a considerable amount of space in staging, loading, and production areas, where such space is at a premium. This problem is clearly evidenced by the prevalence of pallet stacks and pallet "yards" around most manufacturing and distribution facilities.

Sanitation

Since pallets are generally stored outside, they are subject to the accumulation of dirt and debris, the infiltration of parasites, and deterioration from varying weather conditions. This often necessitates some form of cleaning and/or fumigation, especially in food processing facilities or when the ultimate destination (e.g., foreign countries) requires sanitation certification. Splinters and wood chips add to debris and general cleanliness problems within the production or warehousing facility.

Safety

Broken boards, splinters, chips, and protruding nails present safety hazards, and the practice of manually handling the heavy wood pallets very often results in industrial injuries in the form of back strain.

Product Damage

This same deterioration of the wooden pallets is often cited as the cause for product damage during storage or shipment, resulting in the fairly common practice of placing a sheet of cardboard on top of the device prior to loading it with a product.

Disposal

At the end of the distribution channel and/or when a pallet has become too dilapidated to be of any further use, the problem of disposal has to be faced. With environmental concerns being at an all-time high, public landfill facilities often charge premium prices for disposal of pallets, to say nothing of the cost of transportation to get them there. In an attempt to forego this added expense, many facilities will place a "free firewood" sign in the vicinity of the pallet junk pile so that employees or others will assist with elimination of this problem.

In Transit

Continually rising transportation and fuel costs have caused the industry to focus on the most wasteful application of the wooden pallet, namely, the in-transit use of it as a base platform for the transportation of products. Due to its basic configuration and construction materials, the wooden pallet is heavy, often resulting in the waste of over 2000 lbs. of shipping capacity. Due to its dimensions, it also occupies over 200 cubic feet of otherwise usable space. In the common practice of shipping pallet-based loads stacked two-high in a truck or container, the elimination of the vertical 8 or 10 inches occupied by the two bases can often result in the ability to ship an entire extra layer of product on each truckload. This problem is compounded further when a carrier is party to a so-called "exchange program," which requires him to return the pallets to point of origin or to transport them to his next destination. In either case, the same weight and volume is wasted, precluding him from transporting a "full" load of product.

In attempts to address the problems of safety, sanitation, product damage, and longevity, a wide variety of wooden pallet substitutes have been devised over the years. These include devices made of plastic, steel, aluminum, fiberboard, particleboard (compressed wood fibers), combinations of these and other materials, and various other composites in an equally wide variety of configurations. However, where such alternate materials have been used to provide for longevity, strength, and ease of use in the warehouse environment, the resulting products have been too costly to use as a base platform for shipping a product and still have not allowed full utilization of the space within the transporting container.

Among the various attempts to provide a cost-effective, lightweight, and low-profile device for in-transit applications, the "slipsheet" by far has been the most successful, having reached an industry market share of 14% since its inception over two decades ago. This device, generally made of virgin or recycled fiberboard, or various plastic compositions, is generally recognized as the ultimate in low-profile, cost-effective shipping bases. The major drawback to the slipsheet however, and perhaps the major reason that it has not gained more widespread use, is the fact that it requires special handling equipment other than an ordinary lift truck. This equipment, commonly known as "push-pull" machines, either may be a completely separate unit with a price tag of $20,000 to $30,000, or an attachment costing between $5,000 and $10,000 that can be fitted specially to lift trucks. In order for the slipsheet to serve its intended purpose as a one-way transporting base which moves from point of original manufacture throughout the distribution channel, such special handling equipment is required at each loading facility (and often at numerous loading stations within that facility), each intermediate regional or redistribution facility where such unit loads may be transferred, and at each receiver's facility. Since this strategic placement of one or more pieces of special equipment involves a large outlay of capital, only the larger companies who can afford the investment are able to fully utilize the benefits of the slipsheet. When facilities which are not so equipped receive slipsheet-based loads, the product must be transferred carton by carton, onto a wooden pallet or other in-house substitute that the facility is equipped to handle. For this reason, some large companies who are 100% "slipsheet equipped" within their own organizations, will place a slipsheeted load on top of a second device, such as a pallet, when shipping to a customer who is not so equipped, thereby defeating the intended economy of weight and space.

Recognizing this limitation, numerous attempts at devising a low-profile, lightweight, and cost-effective alternative have been made. Ultimately, the industry has been searching for a device that is: compatible with existing equipment, low in profile and lightweight enough to allow for maximum utilization of available space in transport vehicles, inexpensive enough to be used as a one-way device to eliminate expensive return or "exchange" programs, and completely recyclable at the end of the trip.

Paralleling this thinking has been the move toward "unitizing." Over time, with the development of more efficient and cost effective fork trucks and their increasingly widespread use, it became obvious that moving multiple cartons (20 to 80) at one time via this mechanical transfer means, was far more efficient than the transporting of single units, one at a time. In order then to transform multiple cartons into a single, pallet based master unit, numerous methods of unitizing came into being. These include such practices as "shrink-wrapping" (placing a large plastic bag over the entire pallet load and shrinking the bag tightly around the product by the introduction of heat), metal or plastic banding secured tightly around the load, string or twine tying of the load, and the increasingly popular method of "stretch-wrapping" the load with manually or mechanically applied layers of plastic film. Ironically, this increasing practice of unitizing has given rise to the realization that a solid, rigid, and bulky support base, is not really needed.

The costly, bulky, and heavy wooden pallet, though currently still in widespread use, has become an "endangered species." All of the attempts at devising suitable replacements of the same configuration, especially with heights sufficient to allow clearances for mechanical handling equipment, have involved materials or components which have rendered them too costly, and/or too heavy and/or too bulky to be used as a base for the efficient transport of goods.

Of those devices that have addressed the need for a cost-effective, lightweight, and low-profile device for in-transit applications, some have required special handling devices or equipment and/or were constructed of materials or configurations which rendered them commercially unviable. Others, while being constructed of materials and/or configurations which allowed some practical application, were not easy enough to use with existing equipment or did not address the need for entry from two or more adjacent sides. None of these prior art shipping platforms has been usable with both of the most prevalent mechanical handling devices, namely, standard fork trucks and slipsheet equipment.

Therefore, it is an object of this invention to provide an economically constructed platform that is easily used with both types of equipment, namely fork trucks and slipsheet handling equipment.

Also, it is an object of this invention to provide an efficient but simple guide system to allow for easy alignment, both vertically and horizontally, of fork blades when an ordinary fork truck is used to handle the platform.

Additionally, it is an object of this invention to provide for entry of the platform from one side, two adjacent or opposing sides, three sides, or all sides.

Further, it is an object of this invention to provide a lightweight and extremely low profile platform for the transportation of goods in over-the-road or ocean-going containers with the minimum sacrifice of weight capacity and available load space.

Still further, it is an object of this invention to provide a shipping platform that is recyclable and reusable, safe, sanitary, commercially viable, and easily disposable.

BRIEF SUMMARY OF THE INVENTION

A shipping platform is provided which is particularly adapted for handling by both fork lift and slipsheet grasping types of article handling devices. The portion by which the platform is grippable in slipsheet fashion also provides a means for protecting subjacent surfaces from tips of the blades of a fork lift and for guiding the blades in vertical alignment with the platform. Tabs also may be situated above the entry ways of channels for receiving the fork lift blades, with these tabs serving to guide the spaced blades, as well as to prevent closing of the entryways by sagging loads, and to protect the loads from the blade tips d entry into and exit from the channels.

DETAILED DESCRIPTION OF THE INVENTION

Figure 4:
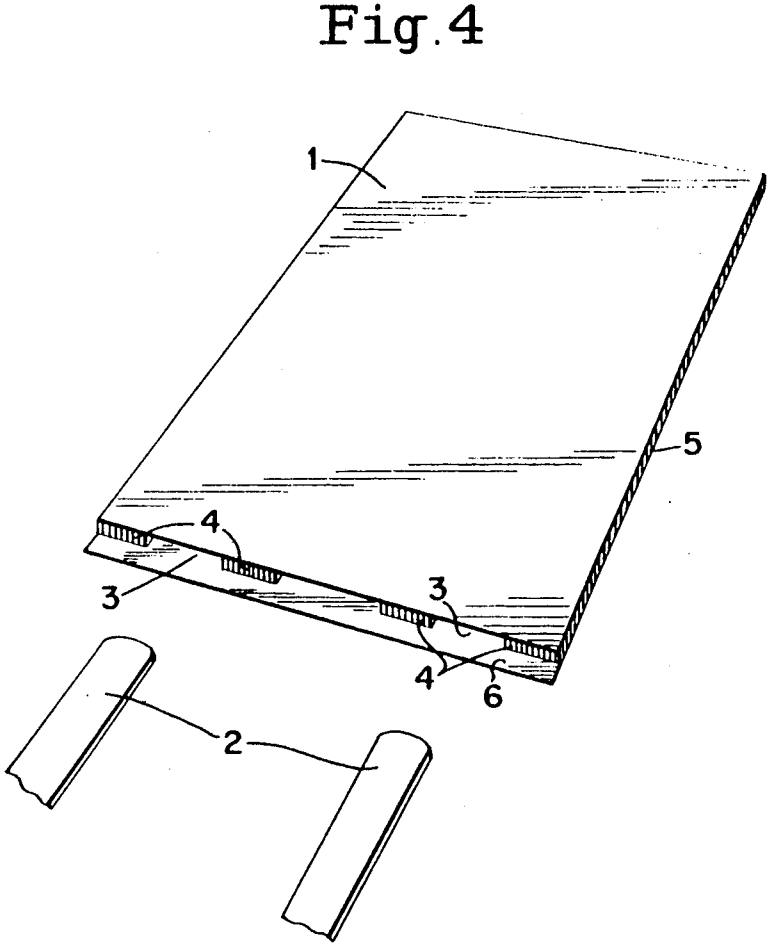
FIG. 4 is a perspective view illustrating the manner in which the blades of a standard fork lift are to be used with the portable shipping platform.
Figure 3:
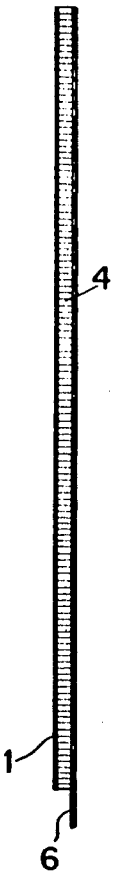
FIGS. 2 and 3 are cross-sectional views, as generally indicated by the arrows 2—2 and 3—3 of FIG. 1.
Figure 1:
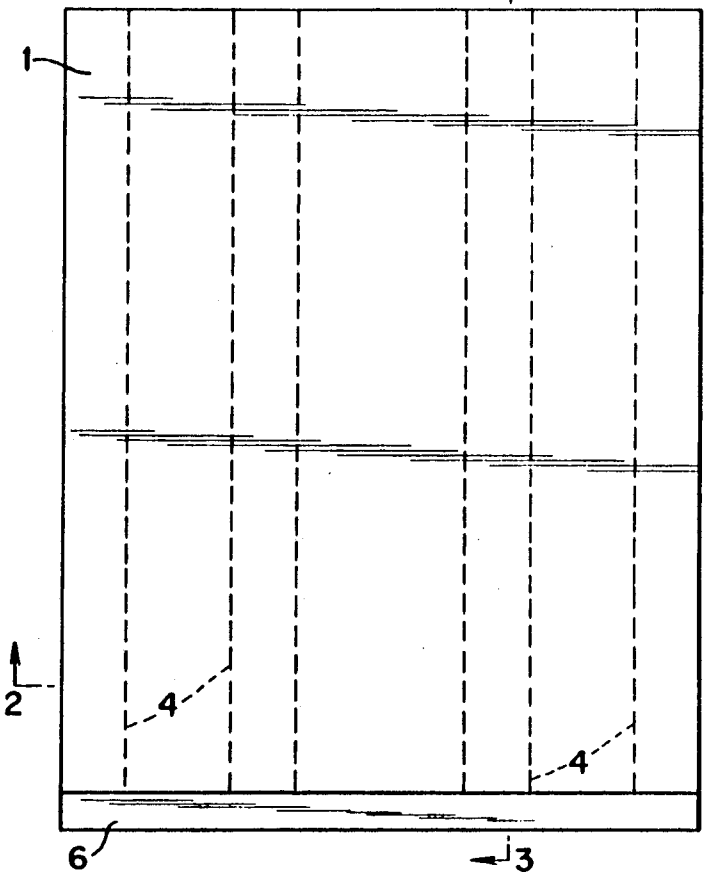
FIG. 1 is a top plan view of one embodiment of the portable shipping platform of the invention.
Figure 2:
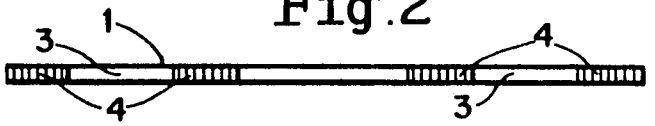
Figures 5, 6, 7, 8, 9A, 9B, 9C:
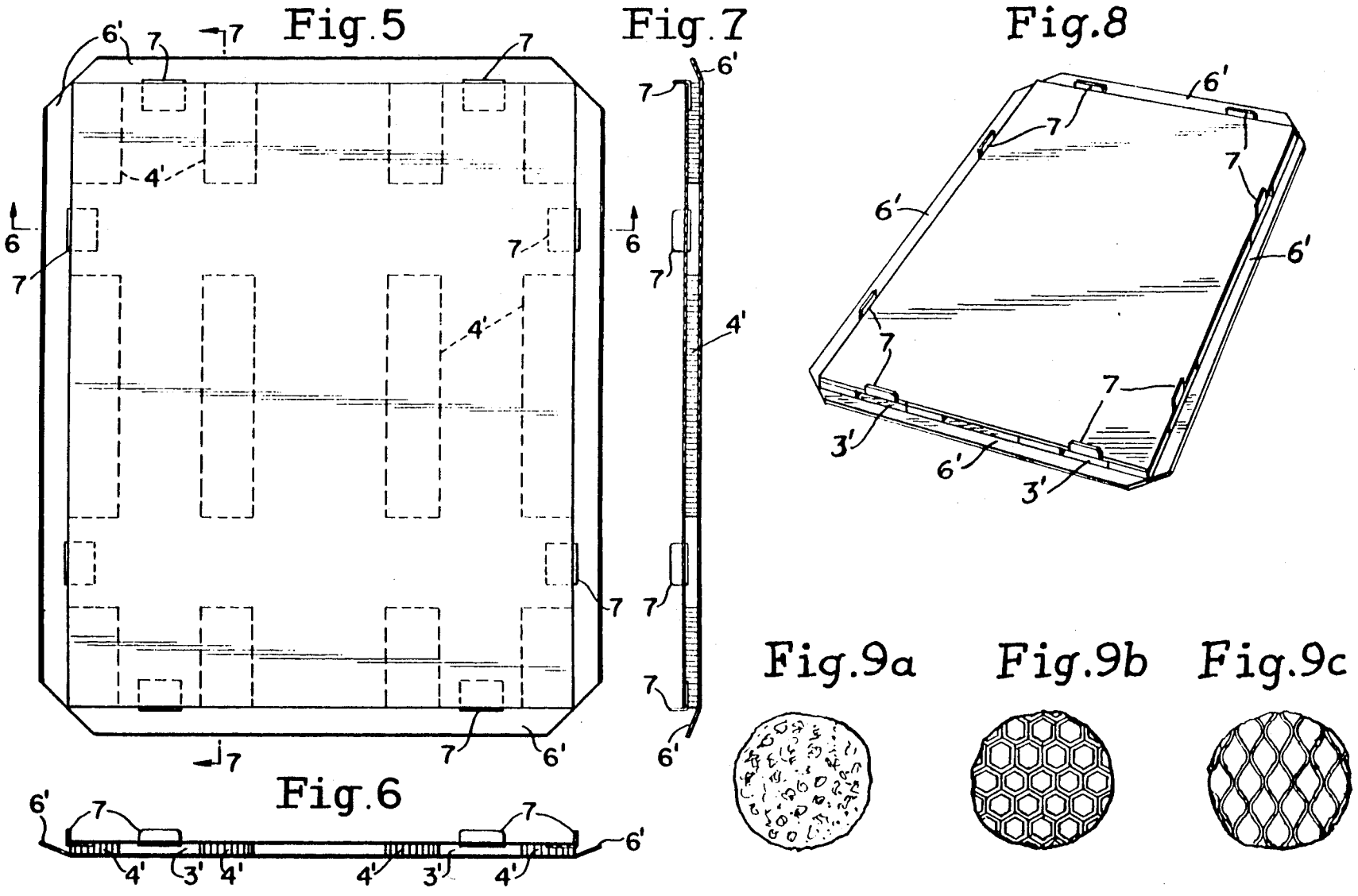
FIG. 5 is a top plan view of a preferred embodiment of the portable shipping platform.
FIGS. 6 and 7 are cross-sectional views, as viewed generally in the direction of arrows 6—6 and 7—7 of FIG. 5.
FIG. 8 is a perspective view of the preferred shipping platform
FIGS. 9*a*, 9*b*, and 9*c* are fragmentary showings illustrating the details of the spacer construction of foam, honeycomb, and corrugated paper board, respectively.

A shipping platform for the support, handling, and transport of loads is provided in the form of two thin flat sheets spaced apart by three or more attached spacing members, with the lower of the two sheets being longer than the other at least at one edge. Referring to FIGS. 1-5, the top sheet 1 serves as the loading target and support for a product load (not shown) and protects the product from lift truck blades 2 as they enter channels 3 defined by the spacing members 4, while the bottom sheet 5 of the two sheets provides subjacent protection from blades 2 to a floor, a base of a transport vehicle or another load upon which this load has been set. An extension of the bottom sheet 5 provides a guide porch or entry step 6 onto which the tips of fork blades 2 may be placed in order to ensure proper vertical positioning of the blades prior to entering the channels 3. Porch 6 also may be tilted upwardly, as shown in FIGS. 5-8 and described later, so as to serve as the gripping tab for a hydraulic gripper channel (not shown) which is common to slipsheet handling devices. In this embodiment, spacing members 4 generally are the same length as the decksheet 1 and are approximately 4" wide.

Entry is accomplished by lowering the fork blades 2 onto the guide porch or entry step 6, and driving the forks into the entry channels 3 The top and bottom sheets 1 and 5 have sufficient flexing ability, at least in the area of the channels 3, to accept blades which are thicker at their "heel" or thickest part than the space created for their entry by the spacing members 4, while maintaining the integrity of the attachment of the sheets 1 and 5 to spacers 4. For example, with $\frac{3}{4}$" high by 7" wide channels it was found that at least one of the sheets 1 and 5 would flex sufficiently to allow total entry of fork blades which were $1\frac{1}{4}$" thick at their thickest part and 4" wide, without damage to the platform. Alternatively, spacers 4 may be provided which expand, with or without flexing of sheets 1 and 5, in order to accommodate full entry of blades 2.

A portable shipping platform having true "four-way" entry and/or utility capability for both fork and slipsheet handling equipment is illustrated in FIGS. 5-8. The spacing members 4' are more numerous, but shorter, and spaced in such a manner as to allow entry and utility from at least two adjacent sides. Although the spacing members 4' may be of varying sizes depending upon the "footprint" of the platform size required, this illustration depicts appropriate spacing for a typical 40"×48" configuration. Therefore, eight of the spacing members are 4"×8", and four are 4"×18". This particular configuration allows for 25" center-to-center spacing of the fork entry channels 3' with each entry channel being approximately 7" wide. Spacer form may be of foam, honeycomb, or corrugated paper board as shown in FIGS. 9*a*, 9*b*, or 9*c*, respectively.

The guide porch or entry step 6' is bent at an angle to the horizontal to provide a gripping tab by which the platform is graspable by a slip sheet gripping device. Preferably, the entry guide porch 6' is crimped or scored so as to be elevated some 20° to 60° to accommodate the gripper channel of slipsheet handling equipment. Entry of standard fork trucks is the same as illustrated in FIG. 4, with the blades 2 being lowered onto the guide porch 6', so as to lower porch 6' to a flattened position, before the entry into channels 3'. Preferably, the raised angle order that it may be gripped easily during subsequent gripping by slipsheet handling equipment. Where adjacent entry porches 6' are required, the common corner of adjacent porches 6' may be cut off at a 45° angle to accommodate the crimping or scoring.

Guide tabs 7 are spaced apart and attached to the top surface of the platform at the entry of each channel 3' to aid in positioning the spaced blades 2 of a fork lift. Guide tabs 7 also provide additional protection for the leading edge of a product loaded on the platform to protect same from the pressure of ordinary fork blades. Some loaded products such as bagged goods are more "fluid" than stiff, and may tend to close the leading edge or opening to the channel 3'. Tabs 7 also serve as means for preventing such closing or blocking of the entryways to channels 3'.

In a preferred embodiment, all materials of construction are recyclable such as paperboard or fiberboard; all adhesives used in construction either are of recyclable and/or biodegradable composition; the spacing members are of paperboard or fiberboard with a honeycomb or corrugated type of configuration; the overall height of the platform does not exceed 2" and, preferably, does not exceed 1"; the top and bottom "deck" sheets are made of 0.050" to 0.125" solid recycled fiberboard; the spacing members do not exceed a height of 2 inches and, ideally, do not exceed $\frac{7}{8}$"; where guide tabs are illustrated as being attached to the deck sheet, said guide tabs are constructed of laminated, recyclable paperboard, approximately 4" square, with a 45° to 90° bend 1" to 2" from one edge and are 0.090" to 0.160" in thickness. Preferably, the spacing members are spaced in such a manner that all entry channels are approximately 25" center to center. The cell diameter of the honeycomb material, whether paperboard or fiberboard, may vary from $\frac{1}{8}$" to 1" to accommodate the necessary static and dynamic compression strengths required for the total platform unit to support loads of a combined weight of 500 to 30,000 lbs. All materials shown may be treated for water resistance and/or have non-skid surface coatings applied. All "guide porches" or "entry steps" extend beyond the vertical plane of the deck sheet by 2" to 4".

The following claims are intended to cover all of the generic and specific features of the invention herein described and all statements of the scope of the invention which, as a matter of language, might be said to fall therebetween. For instance, it is contemplated that porch 6' could be transparent or have marking on the top and/or bottom thereof in order to guide or otherwise aid one in vertical and/or horizontal alignment of blades 2 with channels 3, whether or not loaded platforms are stacked.

Now that the invention has been described, I claim:

1. In a portable, unitary, stand-alone shipping platform comprising upper and lower thin, flat, flexible support sheets and spacers separating said support sheets vertically, said spacers being spaced apart laterally so as to define channels into which blades of a forklift are insertable, the improvement consisting of:

an entry porch formed by extending outwardly at least a portion of one edge of said lower support sheet beyond a corresponding edge of said upper sheet for placement of tips of the blades of a fork lift so as to serve as a guide by which vertical positioning of the blades relative to said channels is facilitated prior to entry of said blades into said channels; and guide tabs protruding from said corresponding edge of said upper support sheet so as to aid in guiding spaced fork lift blades into said channels.

2. A shipping platform as in claim 1, wherein said spacers comprise:

a honeycomb type of structure.

3. A shipping platform as in claim 1, wherein said spacers comprise:

a foam material.

4. A shipping platform as in claim 1, wherein said spacers are not more than about 1" high.

5. A shipping platform as in claim 1, wherein the support sheets and spacers are recyclable and biogradable.

6. A shipping platform as in claim 1, wherein said spacers comprise:

corrugated paperboard with flutes or corrugations running vertically.

7. A shipping platform as in claim 1, wherein said porch protrudes laterally sufficiently farther from said edge than said guide tabs such that lowering of said blades onto said porch can be accomplished without contacting said guide tabs.

8. A shipping platform as in claim 5, wherein said spacers are not more than about 1" high.

9. A portable shipping platform adapted for handling by forks and slipsheet handling types of devices and comprising:

upper and lower thin, flat, flexible support sheets and spacers separating said support sheets, said spacers being spaced apart laterally so as to defined channels into which blades of a fork lift are insertable;

an entry porch protruding outwardly from at least one edge of said lower support sheet beyond a corresponding edge of said upper support sheet and positionable at an angle relative to said lower support sheet in order to provide a means for gripping said platform by a slipsheet gripping device; and guide tabs spaced apart laterally and protruding from said corresponding edge of said upper support sheet, whereby said platform is interchangeably handleable by fork lift and slipsheet handling devices.

10. A shipping platform as in claim 9, wherein said spacers comprise:

a honeycomb type of structure.

11. A shipping platform as in claim 9, wherein said spacers comprise:

a foam material.

12. A shipping platform as in claim 9, wherein said spacers are not more than about 1" high.

13. A shipping platform as in claim 9, wherein the support sheets and spacers are recyclable and biodegradable.

14. A shipping platform as in claim 9, wherein said spacers comprise:

corrugated paperboard with flutes or corrugations running vertically.

15. A shipping platform as in claim 9, wherein said porch protrudes laterally sufficiently farther from said edge than said guide tabs such that lowering of said blades onto said porch can be accomplished without contacting said guide tabs.

16. A shipping platform as in claim 15, wherein said spacers are not more than about 1" high.

* * * * *

UNITED STATES PATENT AND TRADEMARK OFFICE

CERTIFICATE OF CORRECTION

PATENT NO. : 5,111,754

DATED : May 12, 1992

INVENTOR(S) : Stephen C. ADAMS, Jr.

It is certified that error appears in the above-identified patent and that said Letters Patent is hereby corrected as shown below:

At column 4, line 38, "d" should be --during--.

At column 5, line 59, after "raised angle", insert --of porch 6' is recovered upon removing the blades therefrom in--.

At column 7, line 24, "defined" should be --define--.

Signed and Sealed this

Twenty-fourth Day of August, 1993

Bruce Lehman

*Attest:*

BRUCE LEHMAN

*Attesting Officer*

*Commissioner of Patents and Trademarks*